US005348094A

United States Patent [19]

Cholet et al.

[11] Patent Number: 5,348,094

[45] Date of Patent: Sep. 20, 1994

[54] DEVICE AND METHOD FOR PUMPING A VISCOUS LIQUID COMPRISING INJECTING A THINNING PRODUCT, APPLICATION TO HORIZONTAL WELLS

[75] Inventors: Henri Cholet, Le Pecq; Jacques Lessi, Maule, both of France

[73] Assignee: Institut Francais du Petrole, Rueil Malmaison, France

[21] Appl. No.: 75,796

[22] Filed: Jun. 14, 1993

[30] Foreign Application Priority Data

Jun. 12, 1992 [FR] France ..... 92 07141

[51] Int. Cl.[5] ..... E21B 43/12

[52] U.S. Cl. ..... 166/371; 166/50; 166/265

[58] Field of Search ..... 417/431, 432, 63, 53; 166/50, 265, 105.5, 68.5, 312, 371

[56] References Cited

U.S. PATENT DOCUMENTS

| | | | |
|---|---|---|---|
| 1,554,691 | 9/1925 | Reardon | 417/431 |
| 1,716,709 | 6/1929 | Smith | 417/431 |
| 2,872,985 | 2/1959 | Bertuzzi et al. | 166/105.1 |
| 3,380,531 | 4/1968 | McAuliffe et al. | 166/371 |
| 4,056,335 | 11/1977 | Secrist . | |
| 4,749,034 | 6/1988 | Vandevier et al. . | |
| 4,832,127 | 5/1989 | Thomas et al. | 417/431 X |
| 4,878,539 | 11/1989 | Anders | 166/50 X |
| 5,113,937 | 5/1992 | Cholet . | |

FOREIGN PATENT DOCUMENTS

| | | |
|---|---|---|
| 0322958 | 7/1989 | European Pat. Off. . |
| 2372333 | 6/1978 | France . |

*Primary Examiner*—Richard E. Gluck

*Attorney, Agent, or Firm*—Antonelli, Terry, Stout & Kraus

[57] ABSTRACT

A device for pumping a fluid of high viscosity containing a gas and a liquid phase which includes a pump connected to a lower end of a tubular string at the bottom of a well and a device for separating free gas from the liquid phase and for injecting a thinner into the fluid to reduce the viscosity. Injection of the thinner is effected at fluid inlet ports of an inlet device for separating the free gas via a pipe leading to the surface of a geological formation in which the well is positioned. Also, a pumping method using the device involves injecting the thinner into the fluid of high viscosity near an inlet of the pump.

11 Claims, 2 Drawing Sheets

DEVICE AND METHOD FOR PUMPING A VISCOUS LIQUID COMPRISING INJECTING A THINNING PRODUCT, APPLICATION TO HORIZONTAL WELLS

FIELD OF THE INVENTION

The present invention relates to a device and to a method for pumping a viscous fluid, such as a hydrocarbon fluid comprising a liquid phase and a certain proportion of gas. The invention also comprises a system for separating the free gas and a means for injecting a thinning product suited for decreasing the viscosity of the liquid phase obtained after separation of the gas.

What is understood to be a thinning product refers to all the fluids capable of decreasing the viscosity of a viscous fluid once the product is admixed with the fluid. The thinning product may be itself a mixture of several fluids or of fluids and solid or fluid additives, in solution or in suspension. The result of the mixing of the thinning product and of the viscous fluid may take the form of a solution, an emulsion, or both at the same time. In any case, the viscosity of the resulting mixture is lower than the viscosity of said viscous fluid.

In the present application, the simplified usual term "thinner" refers to the "thinning product" such as defined above.

BACKGROUND OF THE INVENTION

Hydrocarbon production plants utilize, after wells have been drilled through producing reservoirs, pumping systems for bringing the hydrocarbon up to the surface. For this operation, a tubular string used as a pipe for producing the hydrocarbons, at the end of which a pump is arranged, is lowered into the well.

The pumps used may have various types: piston pumps, check valve pumps, centrifugal pumps, rotary positive-displacement pumps. These pumps may be driven from the surface through rods displaced in a reciprocating or rotating motion, over the total distance between the pump and the surface, or through underwater means such as a turbine or an electric motor, the primary energy coming from the surface.

Although such pumps work satisfactorily when the fluid pumped mainly consists of liquid, problems arise and grow when a volume of free gas is present in the production fluid. In fact, if the inlet pressure of a fluid fed to a pump is lower than the bubble-point pressure above which all of the gas dissolves in oil, free gas mixed with the production fluid is allowed to pass into the pumps.

Under such conditions, the pumping efficiency is low. This problem is solved by application EP-0,435,716 in which the pump is run into an inlet pipe provided with ports at its upper end and with a check valve system at its lower end. The gas separates from the oil at the level of the ports. The check valve system protects the pump from dry running risks if the level of the hydrocarbon liquids does not reach the ports.

But in case of a viscous production fluid, the pumping device described in document EP-0,435,716 has the following drawbacks.

The viscosity of the production fluid could lead to frequent cloggings of the check valve system which make the systems ineffective. Moreover, in most geologic formations producing viscous fluids, the process of entrainment of solid particles is common, notably because of the fluid consistency. The solid particles, for example sands and sediment, near to the lower end of the inlet pipe cause clogging of the check valves.

The viscosity of the production fluid is such that the pressure drops generated inside the inlet pipe, between the inlet ports and the pump inlet, can make pumping ineffective, notably because of the decrease in the pumping rate resulting therefrom.

Similarly, the pressure drops downstream from the pump increase with the viscosity and lead to a higher power consumption upon pumping.

SUMMARY OF THE INVENTION

The aim of the present invention is to overcome the drawbacks mentioned above by suppressing the check valve system intended to avoid dry running of the pump and by effecting injection of a fluid close to the ports of the inlet pipe. A fluid notably adapted for decreasing pressure drops during the flowing of the mixture obtained with the production flow, be it upstream or downstream from the pump, is selected. The present invention also allows selection of a type of injected fluid having the capacity to be separated as easily as possible from the production fluid, once it has reached the surface, so as to be recycled and to simplify transportation and storage of the production. The selected fluid may favorably dissolve part of the gas which might not have been separated at the level of the ports.

An object of the present invention is to provide a device for pumping a fluid of high viscosity containing a certain proportion of gas, comprising a pump connected to the lower end of a tubular string at the bottom of a well and a fluid inlet device whose lower end is sealed and whose upper end comprises fluid inlet ports; the suction of said pump occurring from the lower end of said inlet device.

The pumping device according to the invention comprises means for injecting a thinner for thinning said fluid of high viscosity, said thinner being injected from the surface. Injection of the thinner into the fluid is performed close to the inlet ports.

The thinner may be injected downstream from the inlet ports.

The inlet device may comprise an annular inlet pipe connecting said ports to said lower end of the tubular string, a fastening part at the upper end, said fastening part may comprise at least one port for injecting the thinner, said port being connected to the surface through a pipe.

The injection pipe may be a tube located in the annular space defined by said tubular string and the inside of said well.

The thinner may be a liquid suited for diluting or for emulsifying said fluid of high viscosity, for the thinner may be light mineral oils of low viscosity, such as kerosine, or water comprising emulsifying additives.

The device according to the invention may also comprise at least one measuring set comprising at least one pressure sensor, the set may be located near to the lower end of the inlet device or near to the upper end of the inlet device.

Said measuring set may be connected to the surface by means of a cable.

The present invention further relates to a method for pumping a fluid of high viscosity, in which a pump is connected to the lower end of a tubular string at the bottom of a well extending from a surface of a geological formation into a production zone, a fluid inlet device whose lower end is sealed and whose upper end comprises ports is arranged, suction of the pump occurring from the lower end, the free gas is separated from the liquid phase of said fluid, the gas running up to the surface through the annular space defined by the outside of the string and the inside of the well, the liquid flowing through said ports towards the pump inlet.

According to the invention, a product thinner for thinning said liquid is injected near to said ports, said injection being performed from the surface.

The device and the method according to the invention are applicable to oil production from substantially horizontal wells.

BRIEF DESCRIPTION OF THE DRAWINGS

Other features and advantages of the invention will be evident from the following description of examples which are non limitative examples and with reference to the accompanying drawings in which.

DESCRIPTION OF THE PREFERRED EMBODIMENTS

Figure 1:
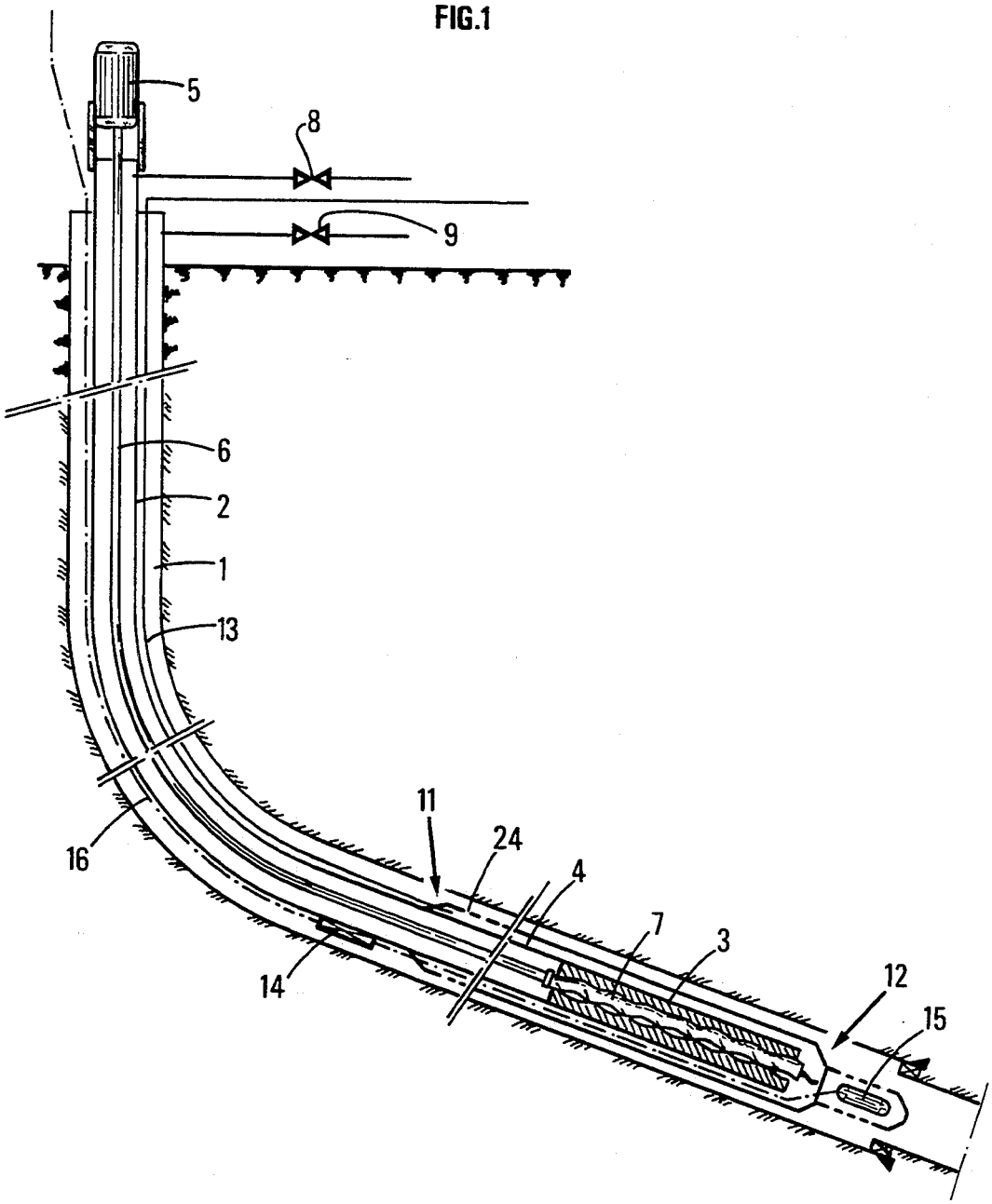
FIG. 1 is a schematic longitudinal section of a wellbore equipped with a tubular string and the device according to the invention.

FIG. 1 shows a well 1 drilled in a geologic formation producing a viscous hydrocarbon. Well 1 comprises a substantially vertical part and a part strongly inclined to the vertical at the level of the producing formation. A pump 3 is fastened at the end of a tubular string 2 by means of a section of another intermediate tubular string 4. The pump 3 shown here is of the rotary screw pump type, such as a Moineau pump, well-known in the pumping technique in oil wells, for example the RODEMIP 400TP900 pump manufactured by PCM Pompes (France). The pump is driven into rotation from motor means 5 located at the surface. A rod 6 transmits the rotation of motor 5 to the rotor 7 of the pump through string 2.

At the surface, the upper end of string 2 comprises sluicing means 8 controlling the fluid delivered by the pump into string 2. Other sluicing means 9 control the fluids which may flow up to the surface by means of the annular pipe defined by the inside of well 1 and the outside of string 2.

An assembly consisting of pump 3 and intermediate string 4 is driven into a string 10 integral with the lower end of string 2 in the zone 11. String 10 is sealed at its lower end 12 and comprises ports 24 allowing inflow of the fluid into the annular space between string 4 and the inside of string 10, said space forming a pipe communicating with the pump inlet.

A pipe 13 extends from the surface to the zone 11 allowing injection of a fluid substantially at the same level as the inlet ports. Pipe 13 is shown parallel to string 2, but it may also be coaxial to string 2.

Two arrays of sensors 14 and 15 are arranged substantially close to the zones 11 and 12 of the inlet device 10. These two arrays 14 and 15 are connected to the surface through a cable 16 located outside string 2. The device according to the invention may comprise a single array, preferably located close to the lower part of the device.

Figures 2, 3A, 3B, 4:
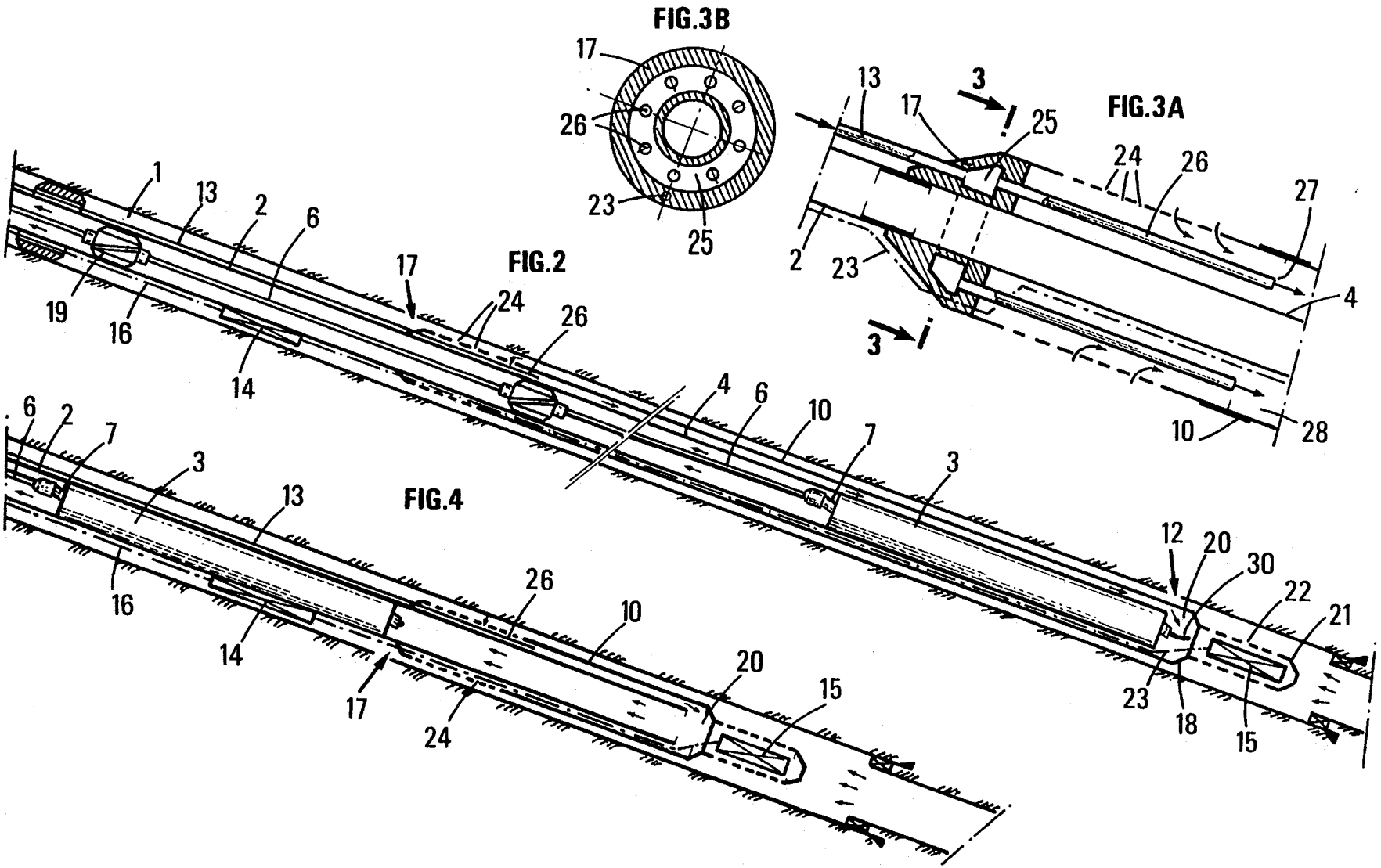
FIG. 2 is a cross-section of the lower part of the tubular string and the device of the invention.
FIGS. 3A and 3B are respectively longitudinal and cross-sections of the upper end of the inlet and injection device.
FIG. 4 shows a variant of the device.

FIG. 2 shows in detail the lower part of string 2 and illustrates more precisely the flow of the various fluids. The inlet string 10 is sealed at its lower end by a piping end 18 comprising a cavity 20 close to the inlet of pump 3 and a means for fastening a housing 21 for protecting the array of sensors 15. Housing 21 comprises ports 22 allowing information transmission to the sensors, for example the pressure in the well or the temperature of the fluid. Cable 23 runs through piping end 18 and connects array 15 to the surface or to the upper array 14, intermediate with the surface. The cable is preferably located in the annular space between the body of pump 3 and the inside of inlet string 10. The raceway of cable 23 through piping end 18 is sealed around the cable by means of joints compressed by tightening, according to the stuffing box technique.

Inlet string 10 is integral with string 2 through a sub 17. Close to this sub 17, string 10 comprises an array of ports 24 distributed over the circumference of the cylinder and communicating the inner space of well 1 with the annular space between the outside of the intermediate string 4 and the inside of inlet string 10.

Cable 23 runs through sub 17 and is connected to the array of sensors 14 located outside string 2, in contact with the fluids present in well 1.

The array of sensors 15 may be or may not be identical to array 14, but the information compared between the lower part and the zone of degassing of the production fluid may be interesting in order to try to optimize the production by pumping.

Pipe 13 is fastened onto sub 17. The device for injecting the fluid coming from the surface through this pipe is shown in detail in FIG. 3A.

During the running of the pumping device, the production fluid coming from the geologic formation reaches at least the level of ports 24. The separation between the free gas and the liquid phase forming the production fluid is achieved by means of ports 24. The gas bubbles escape by running up towards the surface through the annular space between well 1 and string 2, by the principle of segregation between fluids of different density, and the liquid phase flows through ports 24 into the annular inlet pipe communicating with cavity 20 close to the pump inlet. Of course, the principle of the gas separation imposes that the ports are located at a higher level than the lower part of the inlet pipe. The pressure difference shown by the level difference leads to the degassing of the production fluid.

Injection of a thinning product is achieved near to ports 24. In fact, mixing is preferably performed after the degassing of the production fluid in order not to hinder this stage. Furthermore, the earlier the liquid phase is thinned, the easier the flowings take place. The injection zone is thus preferably located very close to the downstream of the separation device. Mixing of the thinner with the production fluid favours the flow into the annular inlet pipe defined by the outside of the intermediate string 4, the body of pump 3 and the inside of pipe 10.

The mixture is thus discharged by the pump towards the surface through the inside of the intermediate string 4, then through the inside of string 2, a circulation which generates pressure drops limiting the pumping efficiency. These pressure drops, due to the mixture, are lower than those which would occur with the production fluid alone.

The advantage of a continuous injection of a fluid through pipe 13 is that it avoids dry running of the pump if the level of the production fluid no longer reaches ports 24 during a sufficient time interval, corresponding to the time taken by the pump to empty the annular inlet pipe. In fact, in this case, the pump receives at the inlet at least the fluid injected through pipe 13.

FIG. 3A shows a longitudinal section of the sub 17 comprising an annular pipe 25 in which pipe 13 opens. A series of extension tubes 26 fastened on the sub 17 communicate with the annular space 25 and comprise at their end a calibrated port 27. The extension tubes preferably distribute the injection of the thinning product beyond and downstream from the inlet ports 24. The extension tubes may have various lengths, for example, at least one extension tube 26 may be long enough to inject directly the thinner near to cavity 20, that is into the lower part of the inlet pipe.

FIG. 3B shows a cross section of sub 17 with a layout of extension tubes 26 in the annular space 28.

These extended injection pipe prevent the thinning product from flowing through ports 24, which would hinder the inlet of the liquid phase of the production fluid.

A means 30 for stirring the inner space of chamber 20 is fastened at the end of the rotor 7 of pump 3. This means 30 is preferably a supple rod for example made of plastics. Rod 30 is made to act as a stirrer through the rotation of rotor 7, thus preventing any considerable accumulation of solids in cavity 20.

FIG. 4 illustrates a variant of the device according to the invention where the pump 3 is not run into inlet string 10 or connected to the lower end of string 2 through an intermediate string 4. In this variant, the pump is assembled between string 2 and sub 17. The inlet device comprising a string 10 is fastened on the sub 17 equivalent to the sub 17 of the version according to FIG. 3A. A string 31 is run into inlet string 10 and fastened onto sub 17, defining thereby an annular inlet pipe. The inlet string comprises ports 24 near to its upper end. The arrows in FIG. 4 show the path of the production fluid, before, then after degassing. The production fluid reaches the level of the ports 24 where degassing occurs. The free gas runs up towards the surface in the annulus defined by well 1 and the outside of string 2. The liquid phase flows through ports 24 into the annulus defined by the inside of inlet string 10 and the outside of string 31. Injection of the thinning product is performed near to ports 24. The mixture of the production fluid and of the product injected flows down to cavity 20 located in the lower part of the inlet string, then it is sucked by pump 3 through the inner channel of string 31. This variant enables an inlet pipe whose size would not allow pump 3 to be run therein to be used. On the other hand, the fluid inlet circuit of the pump is lengthened, but the injection of the thinner minimizes the increase in the pressure drops following therefrom.

An operating method for setting the device according to the invention will be described hereafter.

The inlet pipe 10 equipped with the sub 17, the array of sensors 15 and the cable 23 is assembled from the surface.

The stator of pump 3 extended by intermediate pipe elements 4 is placed into pipe 10. A string 4 is fastened onto sub 17 and a cable 23 is run through sub 17. Also an inlet pipe 10 is assembled with sub 17.

The array of sensors 14 is set and thereafter connected to cable 23 and cable 16. The length of cable 16 is at least equal to the length of well 1 between the position of array 14 and the surface. This length is rolled on a drum.

The device is lowered into the well, down to the desired depth, by adding string elements 2 from the surface while unrolling the necessary cable length 16 from the drum.

Pipe 13 preferably consists of tube elements screwed onto one another after fastening the first element onto sup 17. The tubes of pipe 13 are preferably fastened laterally to pipe 2 as the assembly is taken down.

Within the scope of the present invention, pipe 13 may be a continuous tube commonly called a "coil tubing". The continuous tube is fastened onto sub 17 and lowered at the same time as string 2 and preferably linked to string 2 through clamps. The continuous Cube may be lowered after the pumping device has been set at the bottom of the well and connected onto sub 17 through suited guiding and anchoring means.

A particular variant of the invention may consist in injecting the thinner, through pipe 13, directly near to the lower part of the system, in well 1. The production fluid is thus thinned before it reaches the ports 24 of the degassing pipe.

When the desired depth is reached for the inlet ports 24 with respect to the dynamic level of the production fluid in well 1, the sluicing systems 8 and 9 are assembled and the rotor 7 of the pump is taken down by assembling the driving rods 6. Centralizers 19 are fastened on these rods 6 in order notably to limit friction inside string 2.

When the rotor is placed in the stator of pump 3, motor means 5 are installed at the top of production string 2 at the surface.

We claim:

1. A device for pumping a fluid of high viscosity containing a certain proportion of gas, comprising a pump connected to the lower end of a tubular string at the bottom of a well, a fluid inlet device whose lower end is sealed and whose upper end comprises fluid inlet ports the suction of said pump taking place from the lower end of the inlet device, further said pumping device comprising means for injecting a thinner for thinning said fluid of high viscosity, said thinner being injected from the surface, wherein injection of the thinner into said fluid occurs close to the inlet ports.

2. A device as claimed in claim 1, wherein the thinner is injected downstream from the inlet ports.

3. A device as claimed in any one of claims 1 or 2, wherein said inlet device comprises an annular inlet pipe connecting inlet ports to the lower end, a fastening part at the upper end, said fastening part comprising at least one port for injecting the thinner, said port being connected to the surface through an injection pipe.

4. A device as claimed in claim 3, wherein said injection pipe is a tube located in an annular space defined by said tubular string and inside of said well.

5. A device as claimed in any one of claims 1 or 2, wherein said thinner is a liquid adapted for diluting or for emulsifying said fluid of high viscosity, said liquid comprising light mineral oils, kerosene, or water containing emulsifying additives.

6. A device as claimed in any one of claims 1 or 2, wherein said device further comprises at least one measuring set for measuring at least one of temperature and pressure in the well, said set comprising at least one pressure sensor and being located near to the lower end of the inlet device.

7. A device as claimed in claim 6, wherein said measuring set is connected to the surface of a geological formation in which the well is located by means of a cable.

8. A device as claimed in any one of claims 1 or 2 wherein said device further comprises at least one measuring set for measuring at least one of temperature and pressure in the well, said set comprising at least one pressure sensor and being located near to the upper end of the inlet device.

9. A device as claimed in claim 8, wherein said measuring set is connected to the surface of a geological formation in which the well is located by means of a cable.

10. A method for pumping a fluid of high viscosity containing a liquid phase and a gas, wherein a pump is connected to a lower end of a tubular string at the bottom of a well extending from a surface of a geological formation to a production zone, a fluid inlet device whose lower end is sealed and whose upper end comprises ports, said inlet device being arranged adjacent to an inlet of the pump, suction of the pump taking place from said lower end and free gas being separated from the liquid phase of said fluid, the gas passing up towards the surface through an annular space defined by the outside of the tubular string and an inside of the well, the liquid flowing through said ports towards the pump inlet, said method further comprising injecting a thinner for thinning said fluid of high viscosity near to said ports, said injection being performed from the surface.

11. The method as claimed in claim 10 wherein said method is employed to effect oil production from a substantially horizontal well.

* * * * *